US005261200A

United States Patent [19]

Sasaki et al.

[11] Patent Number: 5,261,200

[45] Date of Patent: Nov. 16, 1993

[54] VIBRATION-PROOFING DEVICE

[75] Inventors: Teruo Sasaki; Kazuhiro Fujisawa, both of Kobe; Akemi Kawanabe, Nishinomiya; Yoshiaki Miyamoto, Takarazuka; Seinosuke Kato, Nishinomiya, all of Japan

[73] Assignee: Sumitomo Gomu Kogyo Kabushiki Kaishi, Japan

[21] Appl. No.: 964,465

[22] Filed: Oct. 21, 1992

Related U.S. Application Data

[63] Continuation of Ser. No. 642,747, Jan. 18, 1991, abandoned.

[30] Foreign Application Priority Data

Jan. 20, 1990 [JP] Japan ..... 2-10910
Sep. 26, 1990 [JP] Japan ..... 2-257873
Sep. 26, 1990 [JP] Japan ..... 2-257874

[51] Int. Cl.[5] ..... E04H 9/02

[52] U.S. Cl. ..... 52/167 RS; 52/167 E; 52/167 T; 248/638

[58] Field of Search ..... 52/167 RS, 167 RA, 167 E, 52/167 EA; 248/638; 384/571, 572, 494, 585, 562

[56] References Cited

U.S. PATENT DOCUMENTS

| | | | |
|---|---|---|---|
| 1,761,659 | 6/1930 | Cummings . | |
| 2,002,934 | 5/1935 | Collins | 52/167 R |
| 3,762,114 | 10/1973 | Eskijian . | |
| 4,006,505 | 2/1977 | Köster et al. | 52/167 R X |
| 4,333,695 | 6/1982 | Evans | 384/562 |
| 4,517,778 | 5/1985 | Nicolai . | |
| 4,523,862 | 6/1985 | Yasui et al. | 384/572 X |
| 4,527,365 | 7/1985 | Yoshizawa et al. | 52/167 R |
| 4,593,501 | 6/1986 | Delfosse | 52/167 R |
| 4,593,502 | 6/1986 | Buckle | 52/167 |
| 4,707,152 | 11/1987 | Neese | 384/572 |
| 4,728,204 | 3/1988 | Colanzi | 384/572 |
| 4,805,359 | 2/1989 | Miyake et al. | 52/167 |
| 4,883,250 | 11/1989 | Yano et al. . | |
| 4,974,378 | 12/1990 | Shustov | 348/638 X |
| 4,991,366 | 2/1991 | Teramura et al. | 52/167 R |

FOREIGN PATENT DOCUMENTS

| | | | |
|---|---|---|---|
| 3408591 | 10/1985 | Fed. Rep. of Germany . | |
| 54-45303 | 4/1979 | Japan . | |
| 57-140453 | 8/1982 | Japan . | |
| 64-17945 | 1/1989 | Japan . | |
| 454202 | 6/1968 | Switzerland . | |
| 1283296 | 1/1987 | U.S.S.R. | 52/167 RS |
| 991469 | 5/1965 | United Kingdom . | |

*Primary Examiner*—Carl D. Friedman
*Assistant Examiner*—Kien Nguyen
*Attorney, Agent, or Firm*—Nikaido Marmelstein Murray & Oram

[57] ABSTRACT

The present invention relates to a vibration-proofing device which supports an upper structure, such as a building, computers and other machines or a floor having such machines mounted thereon, on a lower structure, as a foundation, to allow the upper structure to swing, thereby isolating earthquakes, traffic vibrations and vibrations from the equipment installed in another room so as to protect the upper structure from vibrations. The invention is to provide a bearing type of vibration-proofing device which is simple in construction and capable of reliably absorbing not only horizontal but also vertical components of earthquakes, traffic vibrations and other vibrations, whether they are weak or strong, and which properly operates under low load and produces little vibration during operation. The invention provides an arrangement wherein interposed between upper and lower structures are rolling bodies for horizontally supporting the upper structure for swing movement. The rolling bodies are in the form of cylindrical rollers, elastomeric bodies are interposed between the cylindrical rollers and the upper and lower structures. It is desirable that the cylindrical rollers be stacked in n rows and that these rows of cylindrical rollers form an angle of 180°/n. An air spring or coil spring device is disposed vertically of the cylindrical rollers and a plurality of taper rollers is radially arranged in a horizonial plane vertically of the cylindrical rollers.

9 Claims, 8 Drawing Sheets

FIG.4
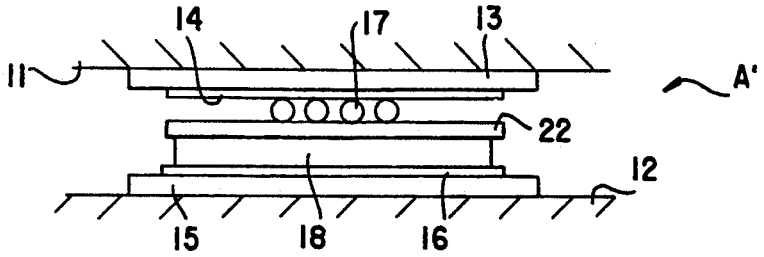
FIG.5
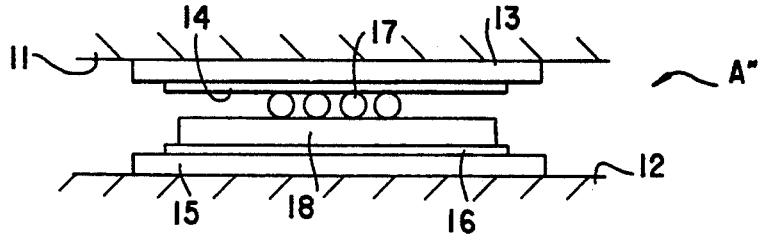
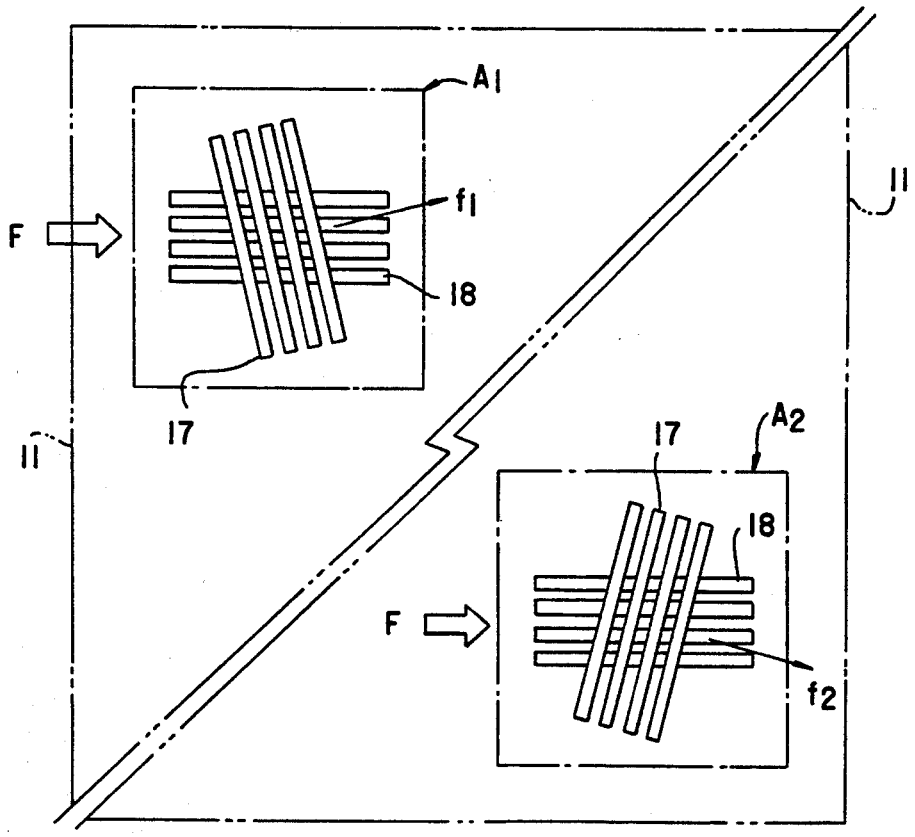
FIG.6

FIG.7
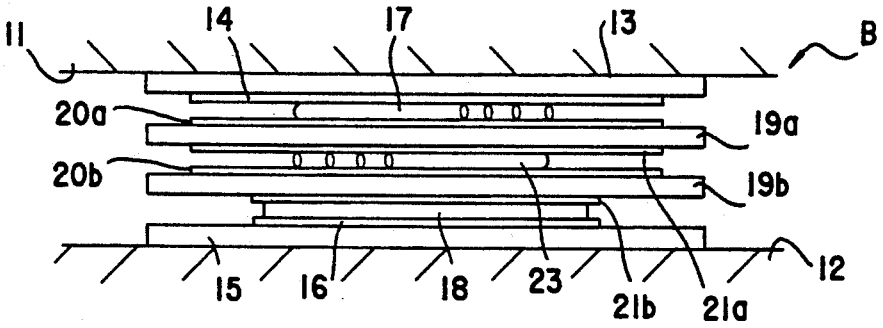
FIG.8
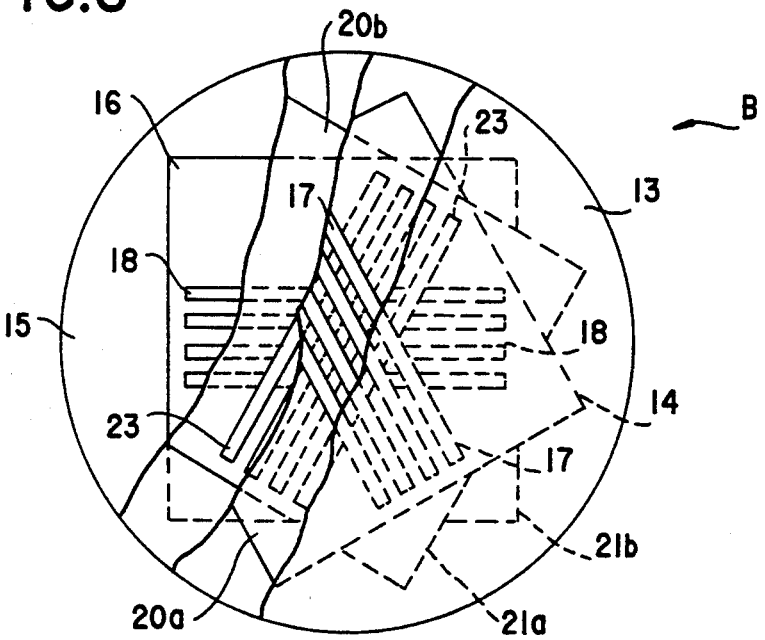
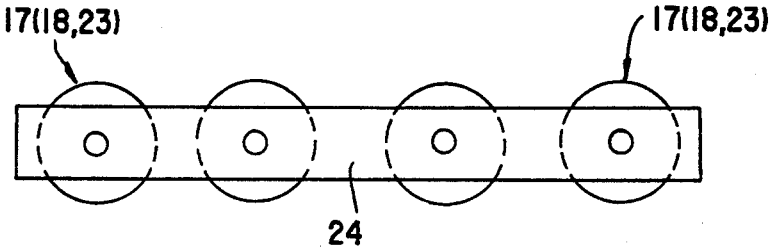
FIG.9

FIG.10
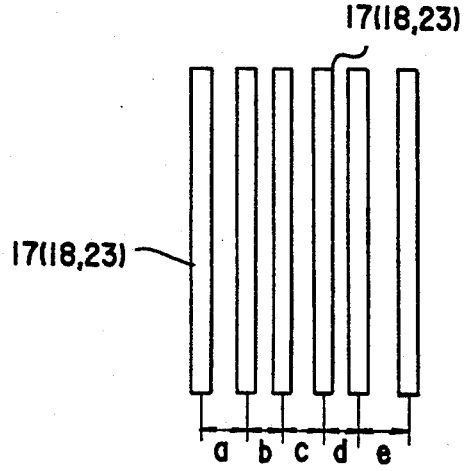
FIG.11
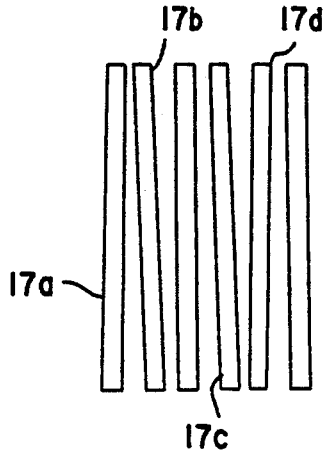
FIG.12
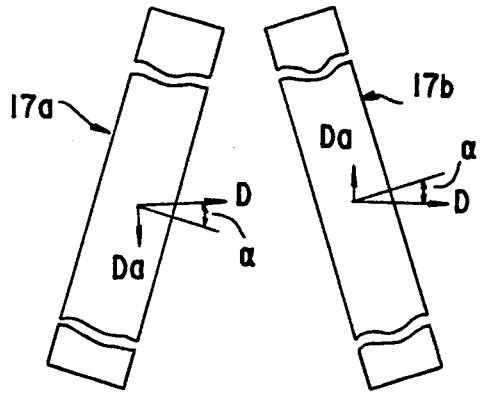
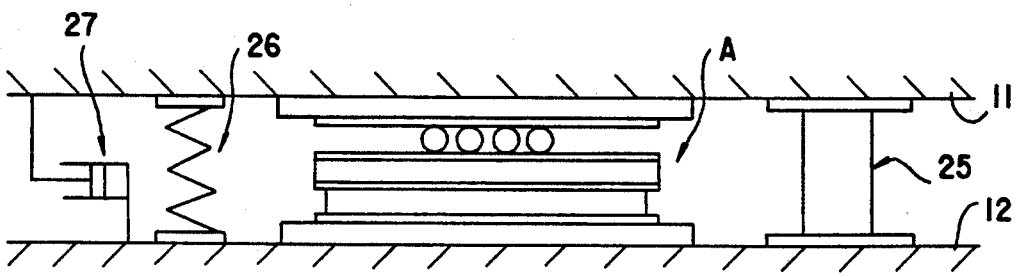
FIG.13

VIBRATION-PROOFING DEVICE

This application is a continuation of application Ser. No. 642,747 filed Jan. 18, 1991, now abandoned.

TECHNICAL FIELD

The present invention relates to a vibration-proofing device and particularly it relates to a vibration-proofing device wherein an upper structure, such as a building, a machine or a floor on which such machine is mounted, is swingably supported on a lower structure, such as a foundation, thereby isolating vibrations, such as earthquakes, traffic vibrations produced around buildings, and vibrations produced from the equipment installed in another room of the building to protect said upper structure from such vibrations. The present invention is also applicable to a dynamic damper designed to reduce resonance, a damper utilizing rolling and/or frictional resistance on rollers, etc.

Various vibration-proofing devices have been developed to protect buildings and machines from vibrations, such as earthquakes and traffic vibrations, by horizontally swingably supporting an upper structure, such as said building, computers and other machines, and a floor on which such machines are mounted, on a lower structure, such as a foundation, so as to reduce the input acceleration to the upper structure as when an earthquake occurs, thereby protecting said upper structure Such vibration-proofing devices include various types: (a) a first type in which a laminate of a soft rubber-like elastic plate, such as natural rubber or synthetic rubber, and a steel plate is used as a support for upper structures, (b) a second type in which a slide member, such as of Teflon, installed between upper and lower structures, is used as a support, and (c) a third type in which a rolling body assembly, such as a ball bearing or roll bearing, is used as a support.

Such bearing type of vibration-proofing device is disclosed in Japanese Patent Application Laid-Open No. 17945/1989. This vibration-proofing device comprises a plurality of ball bearings installed between upper and lower structures so as to support the upper bearing structure for horizontal swing movement, and a stud which allows the upper structure to return to its original position when it is horizontally displaced.

Another bearing type of vibration-proofing device is disclosed in Japanese Patent Application Laid-Open No. 140453/1982. This vibration-proofing device comprises a plurality of roll bearings with eccentric rolls of small and large diameters are installed in two rows in orthogonal relation between upper and lower structures, the arrangement being such that when the upper structure is horizontally displaced on the roll bearings, it is lifted by the eccentric rolls of small and large diameters of the roll bearings. The lifted upper structure lowers to its original position; thus, the potential energy is utilized.

A further bearing type of vibration-proofing device is disclosed in Japanese Patent Application Laid-Open No. 45303/1979. This vibration-proofing device comprises a plurality of roll bearings disposed in two vertically spaced rows, side by side and orthogonal to each other, the arrangement being such that the rolling of the roll bearings absorb horizontal vibrations.

In the conventional vibration-proofing devices, particularly the one described in (a) above, a load of about 50 kg is required per $cm^2$ of the area of the mount, but the amount of movement of the upper structure relative to the lower structure caused as by an earthquake is about 25 cm. To provide for this amount of displacement with safety, it has been required that the outer diameter of the laminated rubber support be not less than 50 cm. Therefore, the total load required for every one laminated rubber support is about 100–300 t or more. In this connection, since a small-sized building, such as a dwelling house, weights about 100–300 t, it has been regarded as difficult to provide a vibration-proofing design using a laminated rubber support. Therefore, each vibration-proofing device for small-sized buildings is desired to have a load support capacity of several tons to tens of tons. The vibration-proofing device described in (b) above is not suitable for structures which should avoid vibration.

Further, in the conventional bearing type of vibration-proofing devices described above, since the ball and roll bearings which support an upper structure are rigid bodies of metal and since the upper and lower structures disposed above and below and in contact with the ball and roll bearings are rigid bodies of concrete or steel plate, there have been the following problems.

First, upon occurrence of an earthquake or traffic accident, not only horizontal but also vertical vibrations take place and the latter vibrations are transmitted directly to the upper structure without being absorbed, resulting in a decrease in dwelling comfortability and damage to machines.

Second, since the areas of contact between the ball and roll bearings and the upper and lower structures are very small, the pressures on the areas are very high, with the result that when strong vertical vibrations are produced during an earthquake, the ball and roll bearings or the upper and lower structures can be easily damaged; this danger is high particularly for ball bearings. If damage has once started in this manner, strong vibrations and loud noises are produced and damage become enlarged during the rolling of the ball and roll bearings, leading to failure in vibration-proofing function.

Third, since it is technically difficult to machine the outer diameters of ball and roll bearings with high precision or to provide accurate spacing between upper and lower structures and maintain accurate parallelism of upper and lower structures, some of the ball and roll bearings fail to function, thus making it impossible to develop the proper vibration-proofing function.

Fourth, if foreign matter in the form of small solids enters the rolling surfaces of ball and roll bearings, it interferes with the rolling of the ball and roll bearings, thus degrading the vibration-proofing function to a great extent.

Last, in the vibration-proofing device disclosed in Japanese Patent Application Laid-Open No. 140453/1982, since a plurality of roll bearings having eccentric small and large diameter rolls are used, if there is a difference in the amount of relative displacement of the roll bearings upon horizontal displacement of the upper structure, the timing with which the upper structure lifted is lowered as it returns to its original position is disturbed for the respective roll bearings, thus producing the so-called rocking phenomenon in the upper structure, which means an increase in the amount of sway of the upper portion of the upper structure. Further, a force greater than the weight of the upper structure acts on the roll bearings, thus damaging the latter.

SUMMARY OF THE INVENTION

Accordingly, the present invention has been proposed with the above in mind and has for its object the provision of a bearing type of vibration-proofing device which is simple in construction and is capable of reliably absorbing not only the horizontal but also vertical components of an earthquake or traffic vibration and which properly functions even under low load and produces little vibration during operation.

The technical means for achieving the above object of the invention lies in an arrangement wherein rolling bodies for supporting an upper structure for horizontal swing are held between the upper and lower structures, said arrangement being characterized in that said rolling bodies are cylindrical rollers, with elastomeric bodies disposed between said cylindrical rollers and the upper and lower structures.

Further, in the present invention, it is desirable that the cylindrical rollers be stacked in n rows and that the rows of cylindrical rollers form an angle of 180°/n.

Further, it is also desirable that an air spring or coil spring means be disposed vertically of the cylindrical rollers or that a plurality of taper rollers be disposed vertically of the cylindrical rollers and radially connected together.

In a vibration-proofing device according to the invention, since the rolling bodies are made in the form of cylindrical rollers, their areas of contact with the upper and lower structures are very large, providing an increased pressure resistance. And the elastomeric bodies disposed between the cylindrical rollers and the upper and lower structures will be elastically deformed under the vertical load of the upper structure to increase the load support areas of the cylindrical rollers, dispersing the vertical load of the upper structure. Further, the elastic deformation of the elastomeric bodies accommodates variations in the outer diameter of the cylindrical rollers and in the parallelism of the upper and lower structures. Further, even if foreign matter in the form of solids adheres to the rolling surfaces of the cylindrical rollers, the elastomeric bodies elastically deform to accommodate them, thereby maintaining the rolling performance of the cylindrical rollers.

Further, said cylindrical rollers are stacked in n rows and the cylindrical rollers between the rows form an angle of 180°/n. With this arrangement, the property of absorbing vibrations in the vertical direction is improved. In addition, when $n=1$, the device acts in one direction only, but when $n \geqq 2$, it acts in all horizontal vibration directions. As this n increases, the difference in the rolling resistance in the horizontal vibration directions decreases. Further, when $n=2$, the angle between the cylindrical rollers in the upper and lower rows must be accurately set at 90°, but when $n \geqq 3$, there will be no problem even if the angle formed by the cylindrical rollers in adjacent rows is not accurately set.

Further, in the vibration-proofing device of the invention, an air spring or coil spring means is disposed vertically of a plurality of rollers interposed between the upper and lower structures, so that not only a weak vibration such as a traffic vibration or a vibration from the equipment in another room but also the vertical component of strong vibration such as an earthquake can be reliably absorbed by the air spring or coil spring means. In the case where an air spring is used, the adjustment of the horizontal level of the upper structure can be adjusted by adjusting the internal air pressure in the air spring.

A plurality of taper rollers are disposed vertically of the rollers interposed between the upper and lower structures and a radially connected together in a horizontal plane. In this arrangement, even if a torsional movement including a rotational component is inputted, the taper rollers are rolled in a horizontal plane in the direction of rotation, whereby the rotational component of the torsional vibration can be reliably absorbed.

Vibration-proofing devices according to embodiments of the invention will now be described with the reference to the accompanying drawings.

BRIEF DESCRIPTION OF THE DRAWINGS

FIGS. 4 and 5 are front views of vibration-proofing devices showing modifications of the first embodiment;

FIG. 6 is a schematic plan view for explaining drawbacks caused by positional shift of the upper rollers in FIG. 2;

FIG. 7 is a front view showing a second embodiment having cylindrical rollers stacked in three rows;

FIG. 8 is a plan view including parts omitted in FIG. 1;

FIG. 9 is a front view of a connecting plate supporting rollers;

FIG. 10 is a plan view showing rollers arranged with different pitches;

FIG. 11 is a plan view showing rollers in slanted arrangement;

FIG. 12 is an enlarged plan view showing a pair of rollers taken from FIG. 11;

FIG. 13 is a front view showing a restoring elastic body and a damper installed between the upper and lower structures;

DESCRIPTION OF THE PREFERRED EMBODIMENTS

Figure 1:
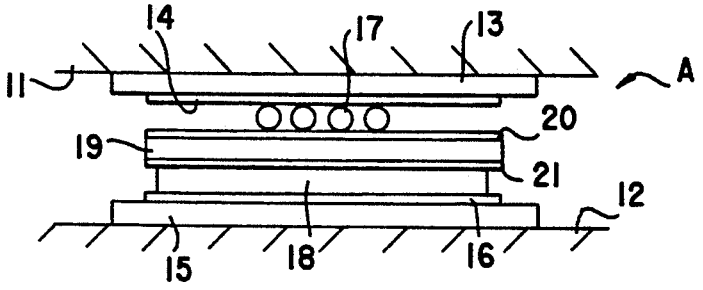
FIG. 1 is a front view of a first embodiment of the invention having cylindrical rollers stacked in two rows.
Figure 2:
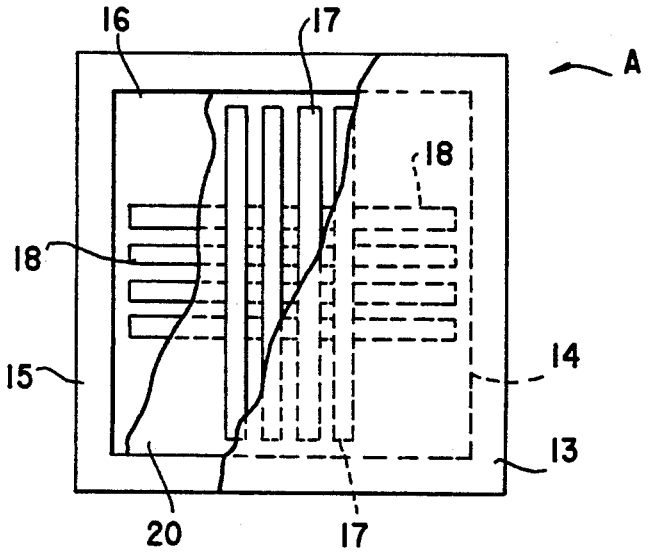
FIG. 2 is a plan view including parts omitted in FIG. 1.

A first embodiment shown in FIGS. 1 and 2 is a vibration-proofing device A having rolling bodies to be later described which are arranged in two rows. This device is installed between an upper structure 11, such as a building, and a lower structure 12, such as a foundation, or, within a building, said device is installed between an upper structure 11 which is the floor on which machines, such as computers and precision measuring instruments, are mounted, and a lower structure 12 which is a slab of the building.

In the vibration-proofing device A of this first embodiment, the numeral 13 denotes an upper pressure resisting plate in the form of a steel plate fixed to the lower surface of the upper structure 11, with an elastomeric body 14 in the form of a sheet bonded to the lower surface thereof as by vulcanization adhesion. The numeral 15 denotes a lower pressure resisting plate in the form of a steel plate fixed to the upper surface of the lower structure 12 in opposed relation to the upper pressure resisting plate 13, with an elastomeric body 15 in the form of a sheet bonded to the upper surface thereof as by vulcanization adhesion. The material of the elastomeric bodies 14 and 16 may be anything that has elasticity, for example, rubber or plastic material. The numerals 17 and 18 each denote a plurality of rolling bodies disposed between the upper and lower pressure resisting plates 13 and 15, which are cylindrical rollers (hereinafter referred to as the upper and lower rollers, respectively). The upper and lower rollers 17 and 18 are stacked in two rows forming an angle of 90°. In addition, the material of the upper and lower rollers 17 and 18 may be anything that can withstand vertical loads, for example, metal, concrete, ceramics, rigid plastics, or FRP. The numeral 19 denotes an intermediate pressure resisting plate in the form of a steel plate or the like interposed between the upper and lower rollers 17 and 18, with elastomeric bodies 20 and 21 in the form of sheets bonded to the upper and lower surfaces thereof as by vulcanization adhesion. With this arrangement, the upper and lower rollers 17 and 18 are held between the upper and intermediate pressure resisting plates 13 and 19 and between the intermediate and lower pressure resisting plates 19 and 15, respectively, through the elastomeric bodies 14, 20 and 21, 16. The surfaces of the elastomeric bodies 14, 20, and 21, 16 against which the upper and lower rollers abut serve as the rolling surfaces for the upper and lower rollers. In addition, instead of applying the elastomeric bodies 14, 16, 20, 21 in the form of sheets to the upper, lower and intermediate pressure resisting plates 13, 15 and 19, the upper and lower rollers 17 and 18 themselves or their surfaces may be formed of elastomer.

Figure 3:
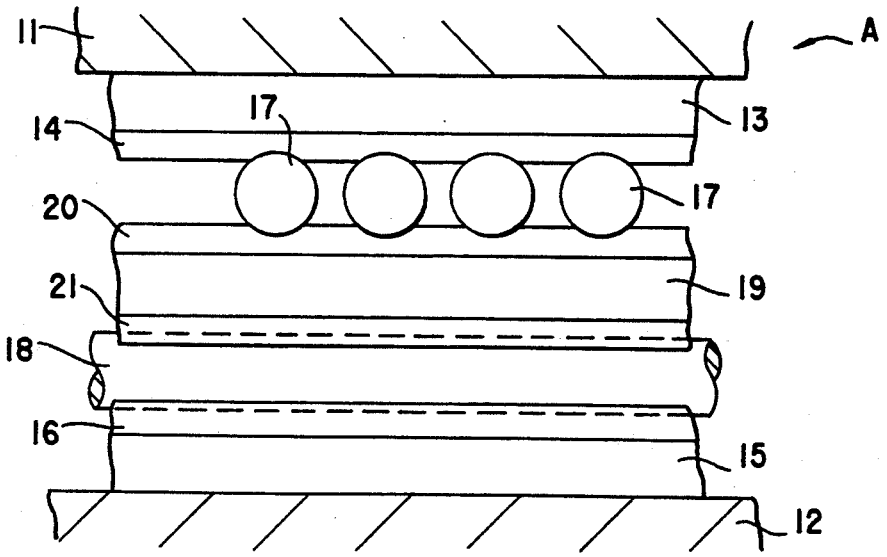
FIG. 3 is an enlarged front view of the principal portion of FIG. 1.

In the vibration-proofing device A of the first embodiment, the upper structure 11 is supported for horizontal swing movement by the upper and lower rollers, so that upon occurrence of an earthquake or traffic vibrations, the input acceleration to the upper structure 11 is reduced to protect the upper structure 11. In this connection, in an actual earthquake, not only horizontal vibrations but also vertical vibrations are produced. In this vibration-proofing device A, since the upper and lower rollers 17 and 18 are cylindrical, their areas of contact with the upper and lower structures 11 and 12 are much larger than when balls are used, thus exhibiting greater pressure resisting performance. Further, since the elastomeric bodies 14, 16, 20 and 21 are disposed on and under the upper and lower rollers, the elastomeric bodies 14, 16, 20 and 21 are elastically deformed, as shown in FIG. 3, thereby increasing the load carrying areas of the upper and lower rollers 17 and 18 and dispersing the vertical load of the upper structure 11. Further, even in the case where the outer dimensions of the upper and lower rollers 17 and 18 vary or where the parallelism of the upper and lower structures is not accurate, this can be accommodated by the elastic deformation of the elastomeric bodies 14, 16, 20 and 21. Further, even if foreign matter in the form of small solids adhere to the rolling surfaces for the upper and lower rollers 17 and 18, the elastic deformation of the elastomeric bodies 14, 16, 20 and 21 accommodate them, thereby maintaining the rolling performance of the upper and lower rollers 17 and 18. In this manner, vertical vibrations can be reliably absorbed by the upper and lower rollers 17 and 18 and the elastomeric bodies 14, 16, 20 and 21.

In the first embodiment described above, a description has been given of the vibration-proofing device A wherein the intermediate pressure resisting plate 19 having elastomeric bodies 20 and 21 in the form of sheets bonded to the upper and lower surfaces thereof is interposed between the upper and lower rollers 17 and 18. However, the invention is not limited thereto. For example, as shown in FIG. 4, instead of using the intermediate pressure resisting plate, an elastomeric body 22 in the form of a sheet alone may be interposed between the upper and lower rollers 17 and 18. Alternatively, an intermediate pressure resisting plate having no elastomeric bodies applied thereto may be interposed or, as shown in FIG. 5, the upper rollers 17 may be placed directly on the lower rollers 18.

In the first embodiment and the modifications described above, the vibration-proofing devices A, A′ and A″ have been described wherein the upper and lower rollers 17 and 18 are stacked in two rows at an angle of 90°. In this case, this angle 90° formed between the upper and lower rollers 17 and 18 must be accurately set.

This reason will now be described. Usually, such vibration-proofing devices will be installed at a plurality of places for a single upper structure. Then, as shown in FIG. 6, if the upper rollers 17 in one vibration-proofing device $A_1$ are somewhat shifted counterclockwise relative to the lower rollers 18 while the upper rollers 17 in another vibration-proofing device $A_2$ are somewhat shifted clockwise relative to the lower rollers 18, then when a horizontal force F acts axially of the lower rollers 18 owing to an earthquake, forces $f_1$ and $f_2$ act on the upper rollers 17 in the two vibration-proofing devices $A_1$ and $A_2$, said forces being orthogonal to the axes of the upper rollers. However, since the upper rollers 17 in the vibration-proofing devices $A_1$ and $A_2$ are positionally shifted as described above, the directions of forces $f_1$ and $f_2$ acting on the upper rollers 17 differ from each other. If the rolling directions of the upper rollers 17 in the two vibration-proofing devices A1 and A2 disposed between the upper and lower structures differ in this manner, the upper structure 11 will sometimes become unable to swing horizontally, failing to develop its vibration-proofing function.

Thus, in the case where it is difficult to set the angle between the upper and lower rollers 17 and 18 accurately at 90°, a vibration-proofing device having cylindrical rollers stacked in three or more rows is preferred.

A second embodiment having cylindrical rollers stacked in three rows will now be described with reference to FIGS. 7 and 8. In addition, parts which are identical or correspond to those of the vibration-proofing device A in FIGS. 1 and 2 are marked with the same reference characters.

This vibration-proofing device B has cylindrical rollers 17, 23 and 18 (hereinafter referred to as the upper, intermediate and lower rollers, respectively) stacked in three rows between the upper and lower structures 11 and 12. The angles formed between the upper, intermediate and lower lowers 17, 23 and 18 are set at 60°. Further, interposed between the upper and lower structures are upper and lower pressure resisting plates 13 and 15 having elastomeric bodies 14 and 16 in the form of sheets bonded thereto to form rolling surfaces for the upper and lower rollers 17 and 18. Further, interposed between the upper and lower rollers are first and second pressure resisting plates 19*a* and 19*b* having elastomeric bodies 20*a*, 21*a*, 20*b* and 21*b* in the form of sheets bonded thereto to form rolling surfaces for the upper, intermediate and lower rollers 17, 23 and 18.

In the vibration-proofing device B of this second embodiment, like the vibration-proofing device A of the first embodiment, upon occurrence of an earthquake, not only horizontal but also vertical vibrations are reliably absorbed to reduce the input acceleration to the upper structure to protect the upper structure 11 from earthquakes. In this connection, in the case of the vibration-proofing device A having two rows of cylindrical rollers, the angle formed between the upper and lower rollers 17 and 18 must be set accurately at 90°, as described with reference to FIG. 6. However, in the case of the vibration-proofing device B having three rows of cylindrical rollers, even if the angles formed between the upper, intermediate and lower rollers 17, 23 and 18 are not set accurately at 60°, since the rollers 17, 23 and 18 compensate each other there is no danger of the upper structure 11 becoming unable to swing horizontally to exert the vibration-proofing function.

In addition, in the vibration-proofing device B of this second embodiment, the first and second intermediate pressure resisting plates 19*a* and 19*b* having elastomeric bodies 20*a*, 21*a*, 20*b* and 21*b* bonded thereto have been used. However, they are not absolutely necessary; as in the case of the vibration-proofing devices A' and A" in FIGS. 4 and 5, elastomeric bodies alone with no intermediate pressure resisting plates combined therewith may be interposed or intermediate pressure resisting plates with no elastomeric bodies bonded thereto may be interposed or the rollers 17, 23 and 18 may be directly stacked using neither intermediate pressure resisting plates nor elastomeric bodies.

As for the elastomeric bodies used in the first and second embodiments described above, those which have a poor damping property may be used. However, since the rolling surfaces of the elastomeric bodies locally moved up and down as the rollers 17, 18 and 23 roll, the performance of the vibration-proofing device can be further improved by using elastomeric bodies of high damping property which are capable of absorbing greater energy as they are deformed.

Further, if the rollers 17, 18 or 23 in each row in the first and second embodiments are supported for rotation by a connector plate 24 as shown in FIG. 9, the positional relation of the rollers 17, 18 and 23 can be desirably maintained. If the connector plates 24 are connected to the associated pressure resisting plates 13, 15, 19*a* and 19*b* so that they are slidable in the rolling direction, the positional relation of the rollers 17, 18 and 23 can be correctly maintained for a long period of use and their durability is desirably improved.

If the elastomeric bodies are subjected to the vertical load of the upper structure 11, the affected areas thereof creep to thereby form recesses. This phenomenon serves as a trigger when they are subjected to a vibration input. However, if they are subjected to a high vibration input, the rollers 17, 18 and 23 fall into the recesses resulting from the creep and vertical vibrations will thus be produced. This can be prevented, as shown in FIG. 10, by setting the pitches a, b, c, d, e of the rollers 17, 18 and 23 so that they all differ ($a \neq b \neq c \neq d \neq e$). With this arrangement, it is possible to prevent all rollers 17, 18 and 23 from simultaneously falling into the recesses resulting from creep.

As shown in FIG. 11, it is also possible to prevent falling into the recesses by inclining the direction of arrangement of the rollers 17, 18 and 23 with respect to the rolling direction. In this case, two rollers which are inclined with respect to the rolling direction by the same angle in opposite directions (17*a* and 17*b* are shown in the figure) must be paired. More preferably, two pairs of rollers (17*a*, 17*b* and 17*c*, 17*d* in the figure) are grouped in one set, whereby satisfactory linear motion and damping property (high reaction) can obtained. The reason will now be described. Referring to FIG. 12 showing two rollers 17*a* and 17*b* inclined with respect to the rolling direction by the same angle $\alpha$ in opposite directions, if a displacement E takes place in the rolling direction, slip takes place between the the rollers 17*a*, 17*b* and the elastomeric bodies by an amount corresponding to a displacement Da or Db corresponding to the angle of inclination $\alpha$, acting as a damping force. In addition, the angle of inclination $\alpha$ is allowed to be about 45°, but since this results in too high resistance or unstability, angles of 30° or less are suitable.

To actually utilize the vibration-proofing devices A, A', A" and B, it is necessary to restore the upper structure 11 to its original position after its horizontal displacement when an earthquake takes place. To this end, as shown in FIG. 13, restoring elastic bodies 25 and 26 in the form of rubber-like elastic bodies or metal springs are installed between the upper and lower structures 11 and 12. In addition, the restoring elastic body 26 in the form of a metal spring may be installed horizontally. Since this restoring elastic body is not subjected to any load, springs of various spring constants ranging from high to low may be used. Generally, when the upper structure is light, springs of low spring constant are used, while when it is heavy, springs of high spring constant are used. Thereby, even if the upper structure weighs only several tens of kg, they can operate well. Further, to exert the damping performance, a damper 27, such as an oil damper, viscosity damper, lead damper, steel rod damper, friction damper or viscoelastic damper, may be installed between the upper and lower structures 11 and 12 to absorb vibration energy, or highly damping rubber may be used as said restoring elastic body 25 of rubber-like elastic material. Further, though not shown, the vibration-proofing devices A, A', A" and B may be provided with a stop for limiting the distance to be traveled by the rollers or a cover for preventing foreign matter from adhering to the rolling surfaces. Said stop may be opposed to the rolling direction of the rollers on the pressure resisting plate, while the cover may be disposed around the entire periphery of the pressure resisting plate so as to surround the clearances storing the rollers, or it may be disposed to close the spaces of the upper and lower structures along the outer wall.

Figure 14:
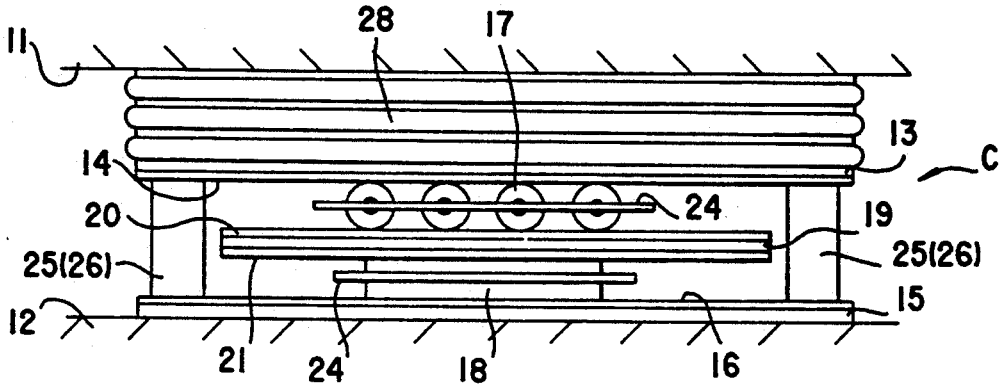
FIG. 14 is a front view showing a third embodiment having an air spring added to the vibration-proofing device of the first embodiment.

A third embodiment of the invention will now be described with reference to FIGS. 14 through 16. In addition, the parts which are identical or correspond to those used in the first embodiment shown in FIG. 1 are marked with the same reference characters.

The vibration-proofing device C of the third embodiment has an air spring 28 added to the first embodiment shown in FIG. 1. More particularly, as described in the first embodiment, the upper rollers 17 are interposed between the upper and intermediate pressure resisting plates 13 and 19 through elastomeric bodies 14 and 20 and the lower rollers 18 are interposed between the intermediate and lower pressure resisting plates 19 and 15 through elastomeric bodies 21 and 16, said upper and lower rollers 17 and 18 being stacked in two rows, forming an angle of 90°. The upper and lower rollers 17 and 18 are respectively rotatably supported in parallel arrangement by their respective connector plates 24. In this third embodiment, the air spring 28 is disposed above the upper and lower rollers 17 and 18. The air spring 28 is fixed at its upper end to the lower surface of the upper structure 11 and at its lower end to the upper surface of the upper pressure resisting plate 13, with air at desired pressure being sealed therein. In addition, restoring elastic bodies 25 or 26 made of rubber or in the form of coil springs are provided between the peripheral edges of the upper and lower pressure resisting plates 13 and 15. Though not shown, as in the case of the first embodiment, various dampers may be provided or highly damping rubber may be used for said restoring elastic bodies 25 or stops and covers may be provided, of course.

In the vibration-proofing device C of this third embodiment, the vertical component of a weak vibration, such as a traffic vibration or a vibration from the equipment installed in another room, is absorbed by the elastic deformation of the elastomeric bodies 14, 16, 20 and 21 forming the rolling surfaces for the upper and lower rollers 17 and 18, while the vertical component of a strong vibration, such as an earthquake, is absorbed by the air spring 28. Further, the horizontal components of a weak vibration, such as a traffic vibration, and of a strong vibration, such as an earthquake, are absorbed in that the upper and lower rollers 17 and 18 roll on the rolling surfaces defined by the elastomeric bodies 14, 16, 20 and 21. In addition, during the rolling of the upper and lower rollers 17 and 18, the elastomeric bodies 14, 16, 20 and 21 elastically deform to thereby exert the damping performance In this manner, three-dimensional vibrations of vertical and horizontal directions of the lower structure due to traffic vibrations or earthquakes are blocked to maintain the upper structure stationary.

Figure 15:
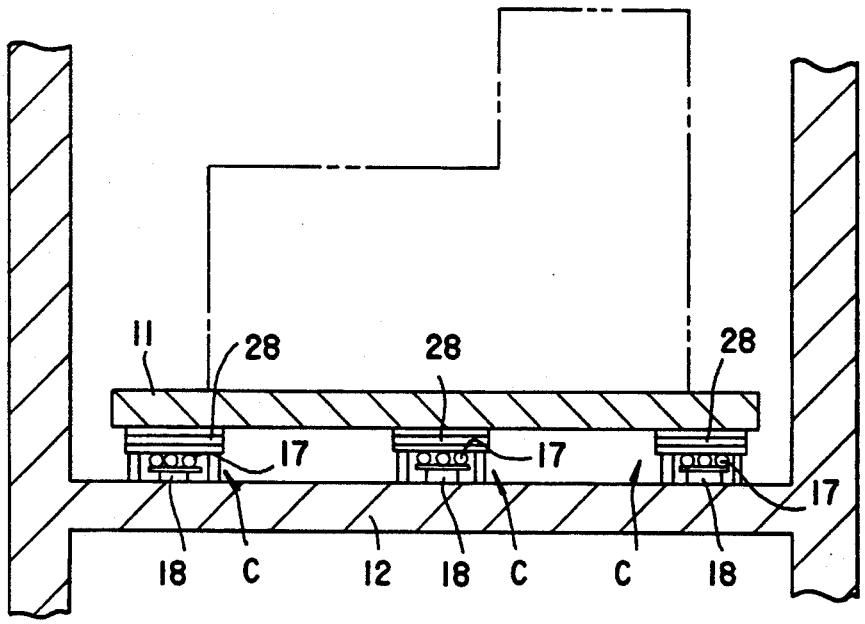
FIG. 15 is a sectional view showing the vibration-proofing device of FIG. 1 applied for proofing floors against vibrations.
Figure 16:
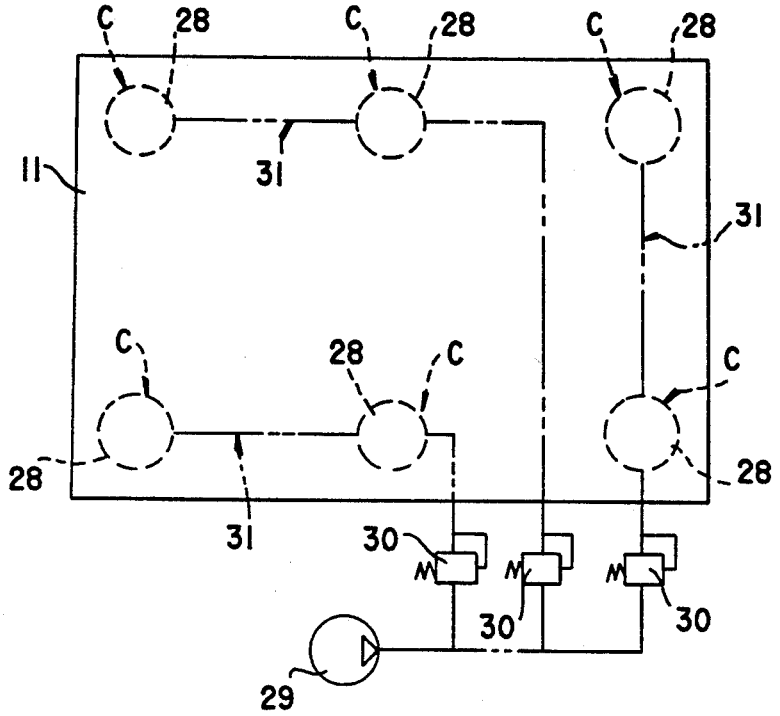
FIG. 16 is a plan view of FIG. 15.

FIGS. 15 and 16 show a floor vibration-proofing arrangement wherein vibration-proofing devices C are applied to part of a building. The planar pattern of a plurality of vibration-proofing devices C disposed between a vibration-proofing floor which is an upper structure 11 and a slab which is a lower structure 12 is designed by vertical load distribution based on the disposition of machines mounted on the upper structure (positions of center of gravity). In this floor vibration-proofing arrangement, in order to supply the air springs 28 of the vibration-proofing devices C with compressed air, there are provided a compressed air supply source 29 and pipes 31 extending from the compressed air supply source 29 to the respective vibration-proofing devices C via pressure reducing valves 30.

Thereby, when the vertical load distribution changes owing to a shift of the disposition (positions of center of gravity) of the machines or when the vertical load distribution somewhat differs from its estimate made before the machines are installed, the level of the vibration-proofing floor which is the upper structure 11 can be adjusted. More particularly, the pressure reducing valves 30 are adjusted to adjust the compressed air pressure supplied to the vibration-proofing devices C from the compressed air supply source 29 via the pipes 31. In the vibration-proofing devices C, the compressed air pressures in the internal spaces of the air springs 28 are increased or decreased to control the respective heights of the air springs, thereby adjusting the level of the vibration-proofing floor.

Figure 17:
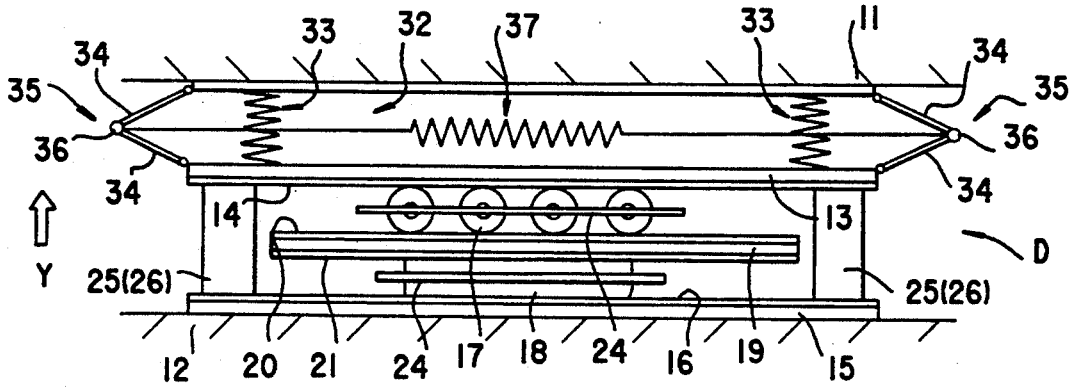
FIG. 17 is a front view showing a fourth embodiment having coil spring means added to the vibration-proofing device of the first embodiment.

In the vibration-proofing device C of this third embodiment, air springs 28 have been used to absorb the vertical component of a strong vibration, such as an earthquake; however, such air springs 28 may be replaced by coil spring means 32 as in the vibration-proofing device D of a fourth embodiment shown in FIG. 17. In addition, the parts which are identical or correspond to those of the vibration-proofing device C of the third embodiment shown in FIG. 14 are marked with the same reference characters to avoid a repetitive description.

The vibration-proofing device D of this fourth embodiment shown in FIG. 17 has coil spring means 32 disposed above the upper and lower rollers 17 and 18. Stated concretely, a plurality of vertical springs 33 are installed between the lower surface of the upper structure 11 and the upper pressure resisting plate 13. A pair of links 35 each comprising two levers 34 are installed between the end edges of the upper structure 11 and the upper pressure resisting plate 13, and a horizontal coil spring 37 is taut between the pivots 36 of the levers 34 of the links 35. In the figure, only one horizontal coil spring 37 is shown, but two or more horizontal coil springs may be provided. Further, it is not absolutely necessary to use both the vertical coil springs 33 and the horizontal coil spring 37 simultaneously; either of them alone may be used.

In the vibration-proofing device D of this fourth embodiment, if a strong vibration, such as an earthquake, is inputted in the direction Y, the vertical coil springs 33 are contracted to produce restoring forces acting in the direction opposite to the direction of contraction, folding the links 35 to stretch the horizontal coil spring 37 while stretching the horizontal spring 37 to produce a restoring force acting in the direction opposite to the direction of stretch. If a strong vibration, such as an earthquake, is inputted in the direction-Y, the vertical coil springs 33 are stretched while the horizontal spring 37 is contracted with restoring forces produced in the vertical and horizontal springs 33 and 37. In this manner, the vertical component of a strong vibration, such as an earthquake, is absorbed by the elastic deformation of the vertical and horizontal springs 33 and 37. The horizontal component of a strong vibration, such as an earthquake, and the vertical and horizontal components of a weak vibration, such as a traffic vibration, are absorbed in the same manner as in the embodiment shown in FIG. 14; therefore, a repetitive description thereof is omitted.

A fifth embodiment of the invention will now be described with reference to FIGS. 18 through 20. In addition, the parts which are identical or correspond to those of the first embodiment shown in FIG. 1, the third embodiment shown in FIG. 14 or the fourth embodiment shown in FIG. 14 are marked with the same reference characters to avoid a repetitive description.

The vibration-proofing device E of this fifth embodiment has means added to the first embodiment for absorbing rotational components. Stated concretely, the vibration-proofing device E has a plurality of taper rollers 38 radially disposed in horizontal plane, this taper roller assembly being located above the upper rollers 17, i.e., between the upper pressure resisting plate 13 and the upper structure 11. In this case, there is no need to provide an elastomeric body on the upper surface of the upper pressure resisting plate 13. Disposed on the lower surface of the upper structure 11 and the upper surface of the upper pressure resisting plate 13 are an inverted conical pressure resisting plate 39 and a conical pressure resisting plate 40, respectively, the lower and upper surfaces thereof having elastomeric bodies 41 and 42 bonded thereto as by vulcanization to form rolling surfaces for the rollers 38. The rollers 38 are rotatably held in radial arrangement by concentric large and small annular connector plates 43 and 44.

In the vibration-proofing device E of this fifth embodiment, when a torsional vibration having horizontal, vertical and rotational components, such as an earthquake, is inputted, the rollers 38 roll around the center O, and the rolling of the rollers in the rotational direction absorbs the torsional vibration including the rotational component. Thus, the invention exerts the superior vibration-proofing function, absorbing all vibrations having horizontal, vertical and rotational components, including weak vibrations, such as traffic vibrations, strong vibrations, such as earthquakes.

Lastly, sixth and seventh embodiments comprising the third embodiment of FIG. 14 and the fourth embodiment of FIG. 17 added to the fifth embodiment of FIG. 15 will now be described with reference to FIGS. 21 and 22.

Figure 18:
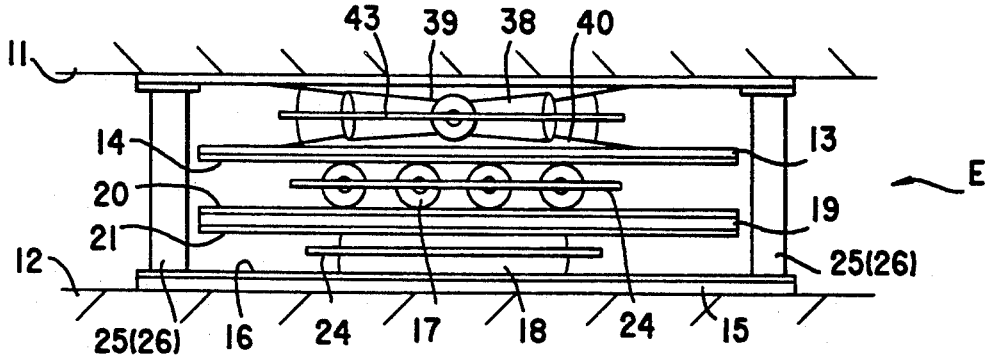
FIG. 18 is a front view showing a fifth embodiment having means added to the vibration-proofing device of the first embodiment, said means being capable of absorbing vibrations including rotational components.
Figure 19:
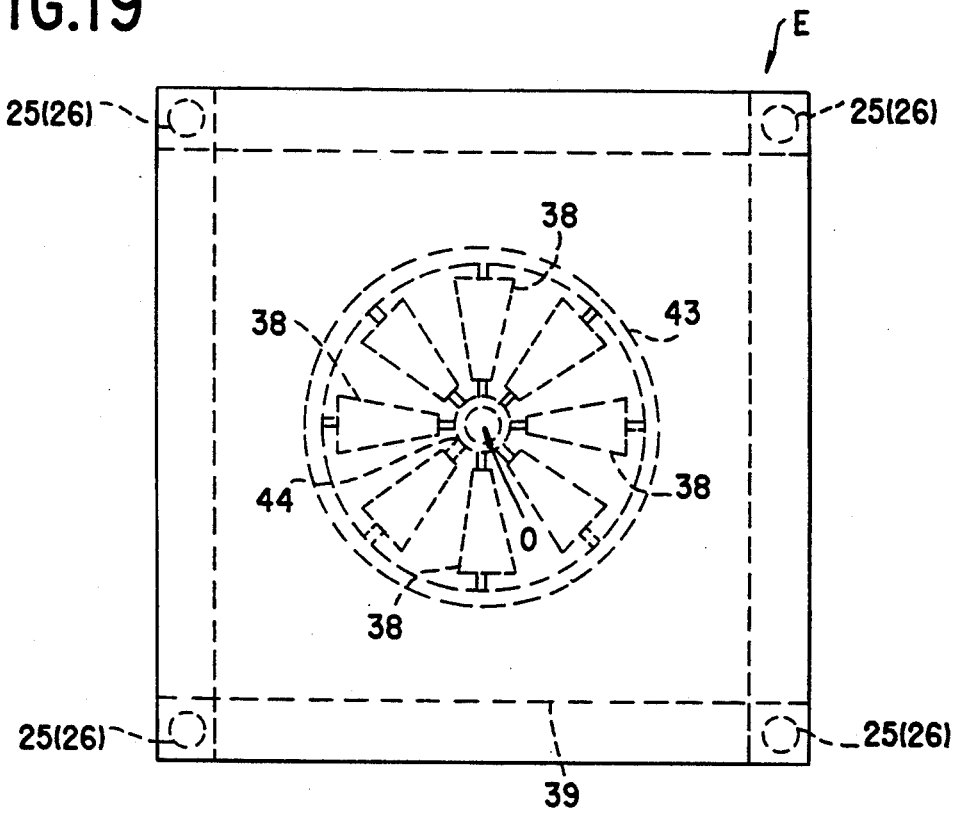
FIG. 19 is a plan view of FIG. 18.
Figure 20:
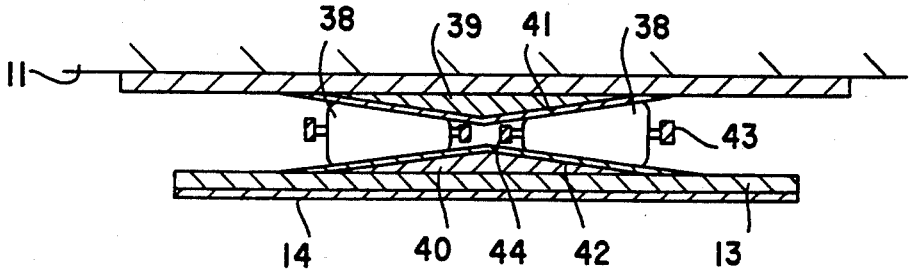
FIG. 20 is a fragmentary enlarged sectional view of FIG. 18.

In the vibration-proofing device E of the fifth embodiment shown in FIGS. 18 through 20, the rolling surfaces for the rollers 17, 18 and 38 are defined by elastomeric bodies 14, 16, 20, 21, 41 and 42 to absorb the vertical components of vibrations. When weak vibrations, such as traffic vibrations or vibrations from the equipment in another room are inputted, the elastic deformation of the elastomeric bodies 14, 16, 20, 21, 41 and 42 exerts satisfactory vibration-proofing function, but when a strong vibration, such as an earthquake, is inputted, there is a danger of it becoming difficult to cope with the situation.

Figure 21:
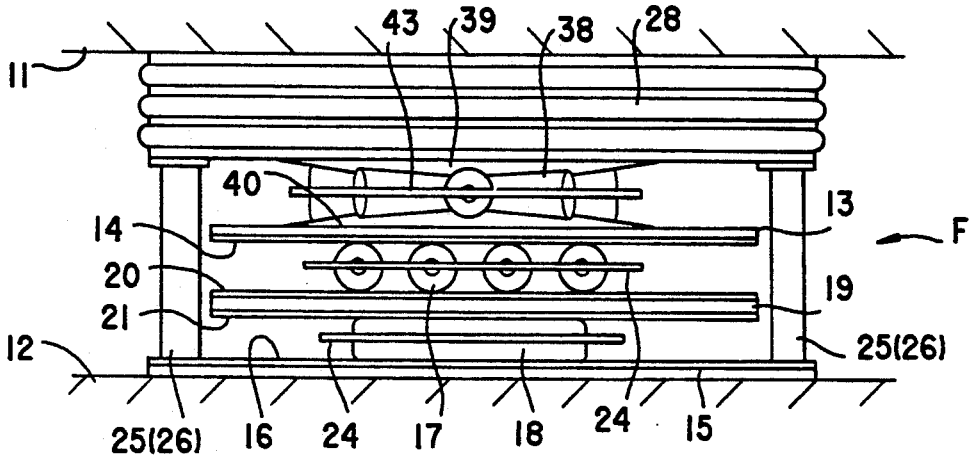
FIG. 21 is a front view showing a sixth embodiment having an air spring added to the vibration-proofing device of the fifth embodiment.
Figure 22:
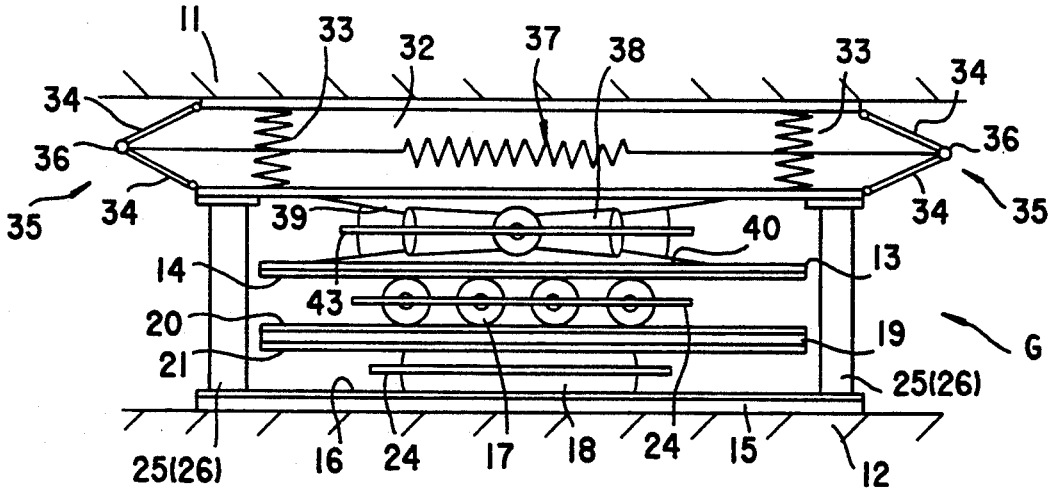
FIG. 22 is a front view showing a seventh embodiment having coil spring means added to the vibration-proofing device of the fifth embodiment.

Accordingly, the vibration-proofing device shown in FIGS. 21 and 22 has means added to the fifth embodiment shown in FIGS. 18 through 20 for reliably absorbing strong vibrations such as earthquakes. In addition, the parts which are identical to those of FIGS. 18 through 20 are marked with the same reference characters to avoid a repetitive description.

The vibration-proofing device F of the sixth embodiment shown in FIG. 21 has an air spring disposed above the rollers 38 of the fifth embodiment, while the vibration-proofing device G of the seventh embodiment shown in FIG. 22 has coil spring means 32, instead of an air spring 28, disposed above the rollers 38 of the fifth embodiment. The air spring 28 and the coil spring means 32 in the vibration-proofing devices F and G of the sixth and seventh embodiments are the same as those used in the third embodiment shown in FIG. 13 and the fourth embodiment shown in FIG. 17 and a detailed description thereof is omitted.

The vibration-proofing devices F and G of the sixth and seventh embodiments shown in FIGS. 21 and 22 exert superior vibration-proofing function, absorbing all vibrations having horizontal, vertical and rotational components, including weak vibrations, such as traffic vibrations, and strong vibrations, such as earthquakes.

In addition, the horizontal component of a strong vibration, such as an earthquake, and the horizontal component of a weak vibration, such as a traffic vibration, are absorbed in the same manner as in the fifth embodiment shown in FIGS. 18 through 20, and a description thereof is omitted.

According to the vibration-proofing device of the present invention, since the rolling bodies are in the form of cylindrical rollers, the vibration-proofing effect is attained for lightweight buildings such as small buildings for which vibration-proofing designs have been considered to be difficult. Further, when vibrations are inputted into the lower structure or when vibrations stop, the cylindrical rollers roll to exert the vibration-proofing effect without producing strong vibrations. Further, since elastomeric bodies are disposed between the cylindrical rollers and the upper and lower structures, the device is superior in pressure resistance, and since no accuracy is required for the outer diameter of the cylindrical rollers and the parallelism of the upper and lower structures, manufacture and installation are easy and the appropriate vibration-proofing function is continuously exhibited; thus, the present vibration-proofing device is highly practical.

If an air spring or coil spring means is disposed vertically of the rollers, the vertical and horizontal components of not only weak vibrations, such as traffic vibrations and vibrations from the equipment housed in another room, but also strong vibrations, such as earthquakes, can be rapidly absorbed. And a vibration-proofing device having a superior vibration-proofing function can be constructed with a simple arrangement. In the case where said air spring is used, the level adjustment of the upper structure can be easily made by adjusting the internal air pressure of the air spring.

Further, if a plurality of taper rollers are radially arranged in a horizontal plane, then upon occurrence of traffic vibrations or earthquakes, the device can absorb torsional vibrations having rotational components as well as horizontal and vertical components.

What is claimed is:

1. A vibration-proofing device comprising:

rolling bodies interposed between upper and lower structures for supporting the upper structure for lateral movement, said rolling bodies being in a form of cylindrical rollers; and elastomeric bodies interposed between said cylindrical rollers and said upper and lower structures for lateral movement of said cylindrical rollers on said elastomeric bodies.

2. A vibration-proofing device as set forth in claim 1, wherein said cylindrical rollers are stacked in horizontal planes, and said cylindrical rollers in each of said horizontal planes form an angle of 180°/n with cylindrical rollers in other of said horizontal planes, where n is a number of said horizontal planes.

3. A vibration-proofing device as set forth in claim 1 or 2, wherein spring means are disposed vertically of said cylindrical rollers.

4. A vibration-proofing device as set forth in claim 1, 2 or 3, further comprising a plurality of taper rollers radially arranged in a horizontal plane vertically of the cylindrical rollers.

5. A vibration-proofing device as set forth in claim 3 wherein said spring means is an air spring.

6. A vibration-proofing device as set forth in claim 5, further comprising a plurality of taper rollers radially arranged in a horizontal plane vertically of said cylindrical rollers.

7. A vibration-proofing device as set forth in claim 3 wherein said spring means is a coil spring.

8. A vibration-proofing device as set forth in claim 7, further comprising a plurality of taper rollers radially arranged in a horizontal plane vertically of said cylindrical rollers.

9. A vibration-proofing device as set forth in claim 3, further comprising a plurality of taper rollers radially arranged in a horizontal plane vertically of said cylindrical rollers.

* * * * *